US009364036B2

(12) United States Patent
Clark

(10) Patent No.: US 9,364,036 B2
(45) Date of Patent: Jun. 14, 2016

(54) MITTENS WEARABLE WITH THE FINGERS AND THUMB EITHER EXPOSED OR COVERED

(76) Inventor: Theresa Clark, Leonard, MI (US)

( * ) Notice: Subject to any disclaimer, the term of this patent is extended or adjusted under 35 U.S.C. 154(b) by 208 days.

(21) Appl. No.: 13/467,089

(22) Filed: May 9, 2012

(65) Prior Publication Data

US 2012/0311766 A1 Dec. 13, 2012

Related U.S. Application Data

(60) Provisional application No. 61/483,866, filed on May 9, 2011.

(51) Int. Cl.
*A41D 19/01* (2006.01)

(52) U.S. Cl.
CPC ..... *A41D 19/01* (2013.01)

(58) Field of Classification Search
CPC . A41D 19/00; A41D 19/006; A41D 19/0003; A41D 19/001; A41D 19/0017; A41D 19/01
USPC ..... 2/158, 159, 169, 170
See application file for complete search history.

(56) References Cited

U.S. PATENT DOCUMENTS

| | | | | | |
|---|---|---|---|---|---|
| 133,183 | A | * | 11/1872 | Whitten | 2/158 |
| 151,527 | A | * | 6/1874 | Whitney | 2/158 |
| 199,738 | A | * | 1/1878 | Parker | 2/163 |
| 428,115 | A | | 5/1890 | Levy | |
| 1,310,120 | A | | 7/1919 | Kreamer | |
| 1,404,453 | A | | 1/1922 | Lynn | |
| 1,849,418 | A | | 3/1932 | Chesebro | |
| 2,274,335 | A | | 2/1942 | Kennedy | |
| 2,315,889 | A | | 7/1942 | Wells | |
| 2,318,785 | A | * | 5/1943 | Kopplin | 2/158 |
| 2,323,136 | A | | 6/1943 | Johanson | |
| 2,451,837 | A | | 10/1948 | La Londe et al. | |
| 2,743,453 | A | * | 5/1956 | Singer | 2/158 |
| 2,830,299 | A | | 3/1957 | Thilenius | |
| 2,836,828 | A | * | 6/1958 | Henrikson | 2/158 |
| 2,937,377 | A | * | 5/1960 | MacKay et al. | 2/158 |
| 3,214,771 | A | * | 11/1965 | Treiber | 2/270 |
| 3,299,441 | A | | 1/1967 | Slimovitz | |
| 3,403,408 | A | * | 10/1968 | Helfer | 2/158 |
| 4,359,784 | A | | 11/1982 | Harrington | |
| 4,383,336 | A | * | 5/1983 | Beckman et al. | 2/158 |
| 4,662,006 | A | * | 5/1987 | Ross, Jr. | 2/158 |
| 5,172,427 | A | * | 12/1992 | Van Bergen et al. | 2/158 |
| 5,509,143 | A | * | 4/1996 | Yates et al. | 2/160 |
| 5,542,125 | A | * | 8/1996 | Zuckerwar | 2/158 |
| 5,678,248 | A | * | 10/1997 | Lengyel | 2/158 |
| 6,249,916 | B1 | * | 6/2001 | Mellon et al. | 2/125 |

(Continued)

*Primary Examiner* — Shaun R Hurley
*Assistant Examiner* — Andrew W Sutton
(74) *Attorney, Agent, or Firm* — John R. Benefiel

(57) ABSTRACT

A mitten is constructed of two fabric sleeves sewn together about the perimeter of respective outer ends, one sleeve drawn into the other to be coextensive and nested together, with a thumb hole on one side of the sleeves adjacent a respective outer end. Insertion of a wearer's hand into an inner sleeve allows the fingers of the wearer to protrude through an opening defined by the perimeter of the sleeve ends and the thumb to protrude out through the thumb opening. When the wearer inserts a hand between the outer and inner sleeves, the fingers and thumb are covered. The sleeves are constructed of fabric panels sewn together, and may be of contrasting color and/or textures, allowing different appearances to be created by reversing the mitten.

8 Claims, 6 Drawing Sheets

(56) References Cited

U.S. PATENT DOCUMENTS 6,338,163 B1 * 1/2002 Markson ..... 2/163
7,191,472 B1 * 3/2007 Kishino ..... 2/160
7,669,252 B2 * 3/2010 Wei ..... 2/239
2003/0154536 A1 * 8/2003 Anderson et al. ..... 2/108
2010/0077533 A1 * 4/2010 Munda ..... 2/161.1
2012/0311766 A1 * 12/2012 Clark ..... 2/158

* cited by examiner

MITTENS WEARABLE WITH THE FINGERS AND THUMB EITHER EXPOSED OR COVERED

CROSS REFERENCE TO RELATED APPLICATION

This application claims the benefit of U.S. provisional Ser. No. 61/483,866, filed on May 9, 2011, incorporated by reference herein.

BACKGROUND OF THE INVENTION

This invention concerns hand coverings and in particular mittens. Mittens are worn for maximum warmth as compared with gloves due to the covering of the fingers together, to warm each other and to reduce the area exposed to the cold, but have the disadvantage of impeding effective use of the fingers and thumb. For this reason mittens have heretofore been proposed which allow the fingers and in some instances the thumb of the wearer to be optionally exposed when greater dexterity is required.

These mittens typically have openings formed by unzipping or folding back a section of the mitten through which the fingers and/or the thumb can be extended. This often creates a loose flap on the mitten, which itself gets in the way. Expensive and troublesome to operate zippers are also typically involved, such as in the mittens shown in U.S. Pat. Nos. 3,299,441; 1,404,453; 1,849,418; 2,274,335; 2,451,837; 2,323,136; 2,318,785; 3,403,408; 2,315,889; 428,115 and 1,310,120.

Also, the fingers may either be insufficiently or overly exposed in the mitten shown in U.S. Pat. No. 2,836,878 and enclosed by rolled up coverings which adversely affect use of the fingers.

In U.S. Pat. No. 5,172,427, a hand covering is shown in which the fingers and thumb are normally enclosed together making effective use of the thumb impossible except when the entire hand is exposed.

It is the object of the present invention to provide mittens which allow the wearer to conveniently expose the fingers and thumbs of the wearer without the need for unzipping openings or creating loose flaps when the fingers and/or the thumb are exposed.

It is another object to provide a mitten which allows the fingers and thumb to be exposed in a way that enables good dexterity of the fingers and thumb.

SUMMARY OF THE INVENTION

The above recited objects and other objects which will become apparent upon a reading of the following specification and claims are achieved by a mitten incorporating a pair of sleeves made of a flexible sheet material such as a suitable insulating fabric. The sleeves are sewn together end to end about their respective open ended perimeters. A thumb opening is formed on one side adjacent the sewn together sleeve ends by attaching the outer sleeve to the inner sleeve by an encircling seam defining a thumb hole extending through both sleeves.

After being sewn together from the inside, the sleeves are turned inside out and one sleeve is pulled back into the other sleeve so that both sleeves are nested coextensively together with both cuffs at one end and with a finger opening defined at the other outer end of the sleeves.

A wearer inserts his or her hand into the innermost sleeve and pulls the mitten onto his or her hand. The fingers will then pass out of the opening at the sewn together outer ends to be exposed. At the same time the thumb will pass out through the thumb opening at one side of the mitten.

To completely enclose the fingers and thumb, the wearer removes the mitten and inserts his or her hand between the two sleeves at the cuff end of the mitten and pulls the mitten down onto his or her hand. The ends of the individual sleeves being sewn together between their ends effectively covers the fingers. The thumb opening is also closed off by the seam extending around the thumb opening, such that the thumb is also covered. The covered fingers and thumb can protrude through the closed off finger and thumb openings to a limited extent to allow some limited dexterity in the use of the fingers and thumb even when the mitten is worn in the manner enclosing the fingers and thumb.

The sleeves are each preferably constructed of pairs of fabric panels sewn together along adjoining sides of the panels except for a short segment near the outer ends. The thumb hole is formed by wrapping the segments of the one side of the outer sleeve panels inwardly to adjacent panel sides of the inner sleeve to which they are respectively attached as by being sewn, forming an elongated thumb hole intermediate the two panels of each sleeve.

The pairs of panels of fabrics may be of contrasting textures and/or colors with each other and each sleeve can be comprised of two contrasting color and/or texture panels so that the mitten is made to be reversibly wearable by being turned inside out. The panels in each pair may also contrast with each other to add to the design appeal of the mitten.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
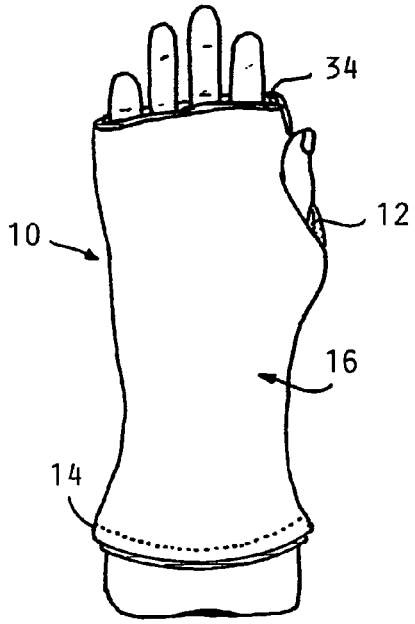
FIG. 1 is a front view of a mitten according to the present invention on the hand of a wearer so as to expose the fingers and thumb.
Figure 2:
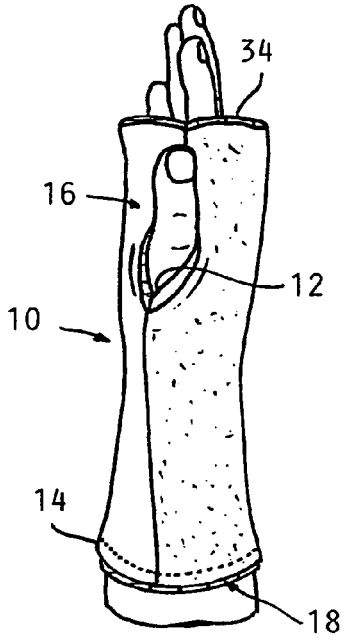
FIG. 2 is a side view of the mitten worn on a wearer's hand in the manner shown in FIG. 1.

Referring to the drawings and particularly FIGS. 1-3B, a mitten 10 according to the invention is shown on the hand of a wearer. In being worn as shown in FIGS. 1 and 2, substantially the full length of the wearer's fingers protrude out from the open outer end of the mitten 10 and the thumb protrudes out through a thumb opening 12 in the side of the mitten 10 closely spaced below the outer end of the mitten 10.

The mitten 10 is long enough so that a hemmed cuff 14 extends well past the wrist of the wearer when the mitten is put on.

Figure 3A:
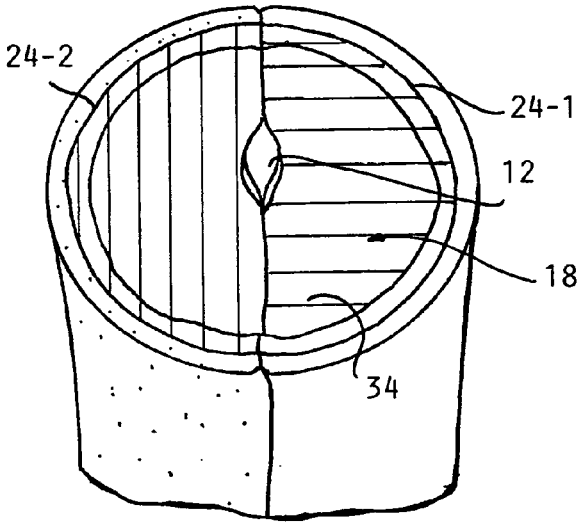
FIG. 3A is a fragmentary end view of the mitten shown in FIG. 1 showing the open end and thumb opening.
Figure 3B:
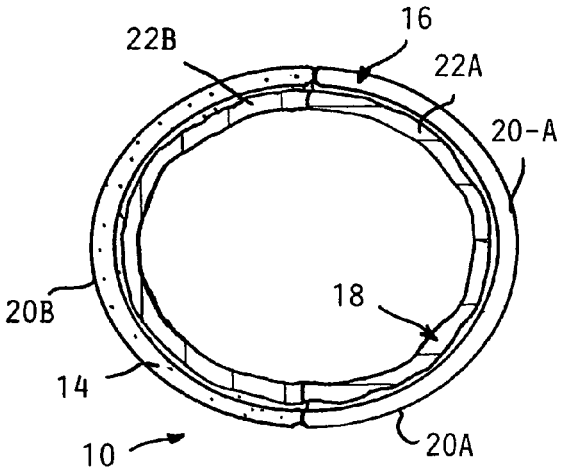
FIG. 3B is a cuff end view of the mitten shown in FIG. 3A removed from the wearer's hand.

As seen in FIG. 3, the mitten 10 includes a pair of end-to-end connected sleeves 16 and 18 which when the mitten 10 is worn are extended one within the other to be coextensive and nested together.

Figure 10:
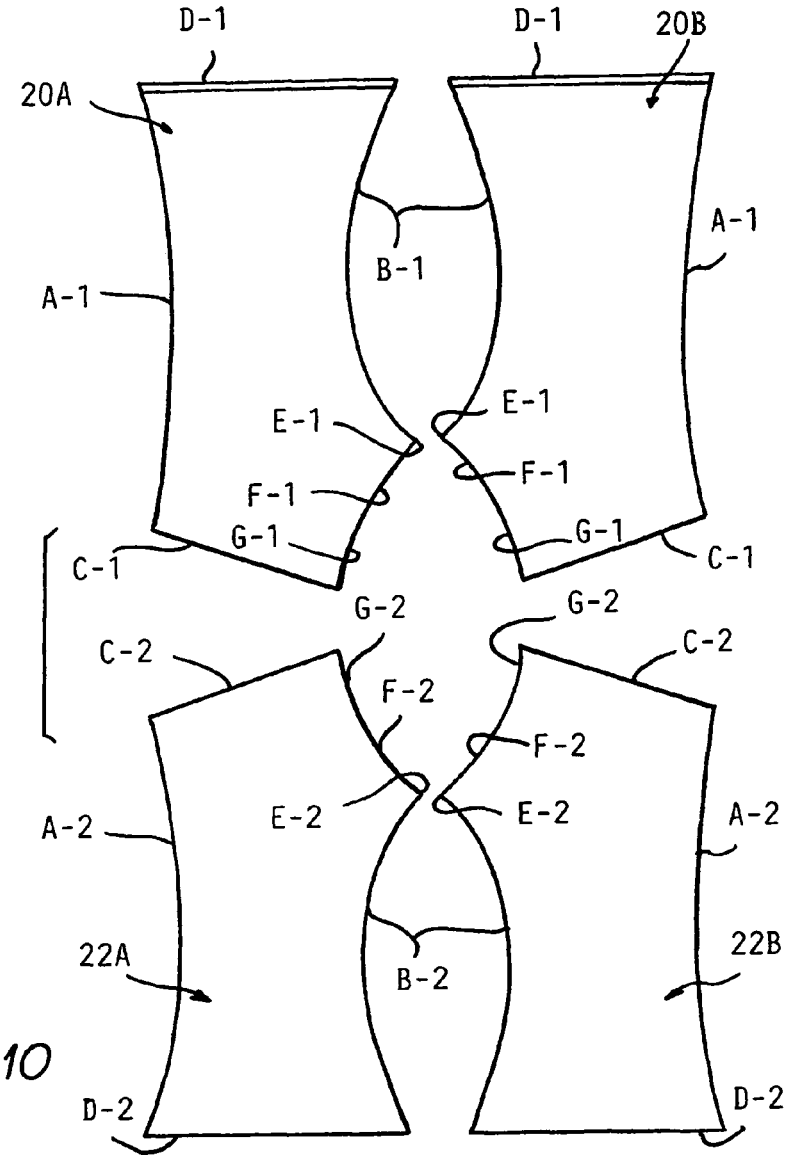
FIG. 10 is a plan view of the four fabric panels which are sewn together to form the sleeves incorporated in the mitten shown in FIGS. 1 and 2.

Each sleeve 16, 18 may be constructed from two pairs of panels of a flexible sheet material such as insulating fabric panels 20A, 20B and 22A, 22B (FIG. 10) are cut in matching patterns, which panels may have contrasting colors and/or textures.

The mitten 10 may be reversible by being turned inside out to expose the outside of the inner sleeve 18 which is finished and does not show the seams on one side so as to have a good appearance when exposed by turning the mitten 10 inside out.

Further details of construction of the mitten 10 will be described by reference to FIGS. 4A, 4B, 4C, 6, 7, 9A, 9B and 10.

To form the sleeves 16, 18, each pair of fabric panels 20A, 20B and 22A, 22B are placed atop each other with their patterns aligned.

The pairs of panel 20A, 20B and 22A, 22B each have sides A-1, A-2, B-1, B-2, an outer ends C-1, C-2 and cuff ends D-1, D-2.

The sides A-1, A-2, B-1, B-2 are mildly flared adjacent to the ends C-1, C-2, D-1, D-2 to fit better. The sloping of outer end C matches the progressively shorter middle, ring and little finger. The sides A-1, A-2 are slightly curved while the thumb sides B-1, B-2 each curve and angle out to a peak E-1, E-2 in order to widen the sleeves 16, 18 to accommodate the increased wideness of the hand at the thumb.

Respective sloping ends C-1 are each sewn to a respective one of the sloping ends C-2 forming seams 24-1, 24-2 connected at either end to each other to extend about the complete perimeter of the outer end of the sleeves 16, 18.

Figure 6:
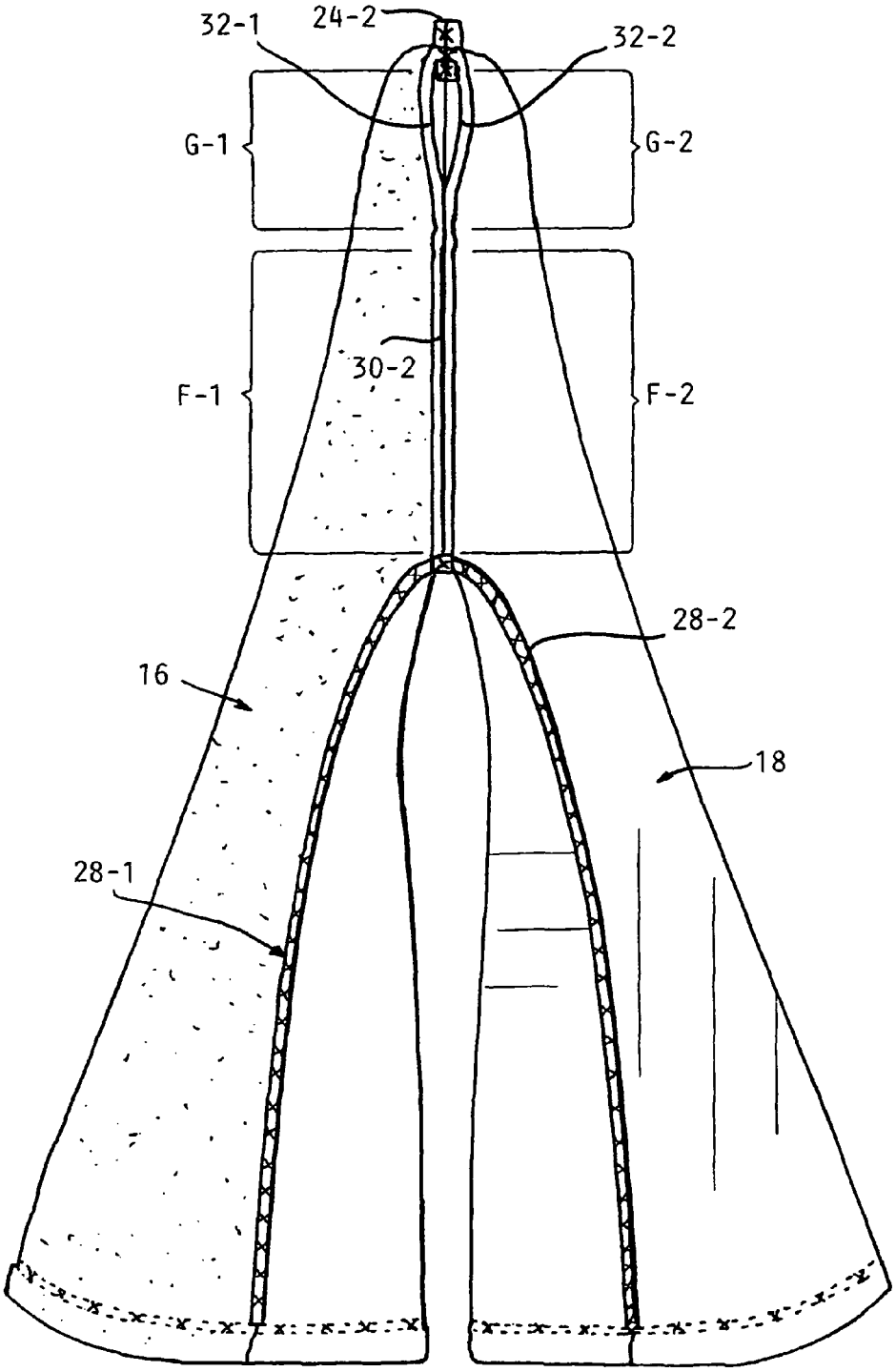
FIG. 6 is a pictorial view of the two sleeves turned inside out and on edge extending away from each other from the thumb side.

After the panels 20A, 20B, 22A, 22B are positioned atop each other in a congruent relationship to adjoin 20A and 22A with 20B and 22B respectively, G-1, G-2 are sewn to join 20A to 20B and 22A to 22B, forming seams 32-1 and 32-2 in (FIG. 6).

Figure 4A:
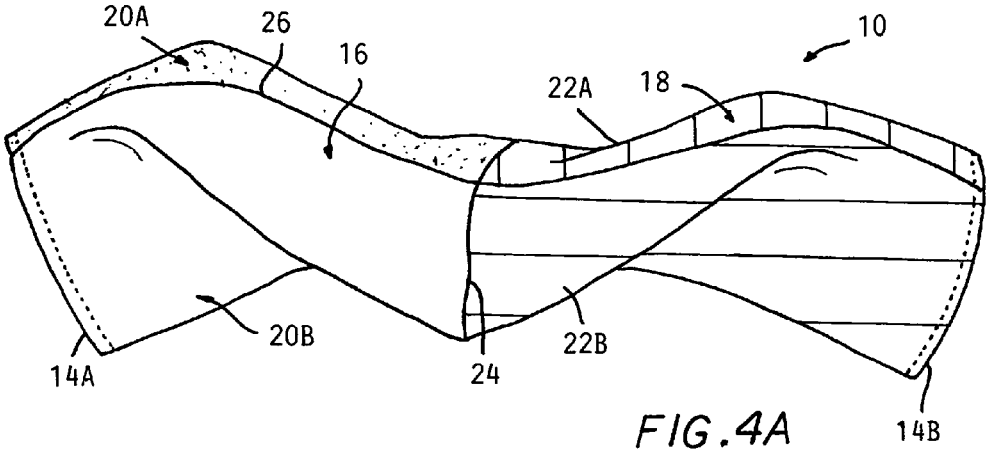
FIG. 4A is a view of the mitten shown in FIG. 1 with an inner sleeve pulled out from an outer sleeve through the finger end opening.
Figure 4B:
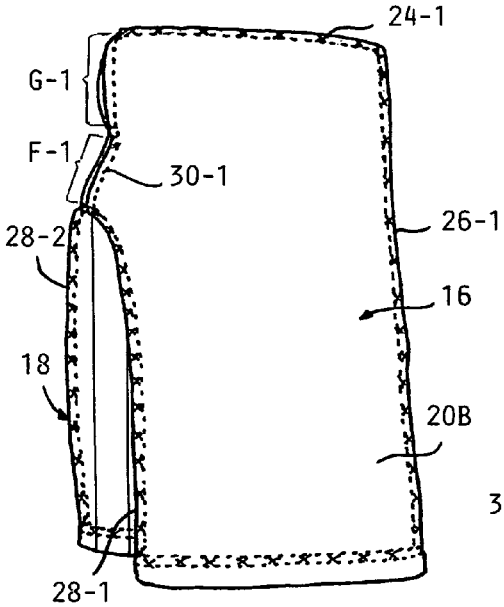
FIG. 4B is a top view of the two sleeves of the mitten turned inside out and folded together to lie atop each other.
Figure 4C:
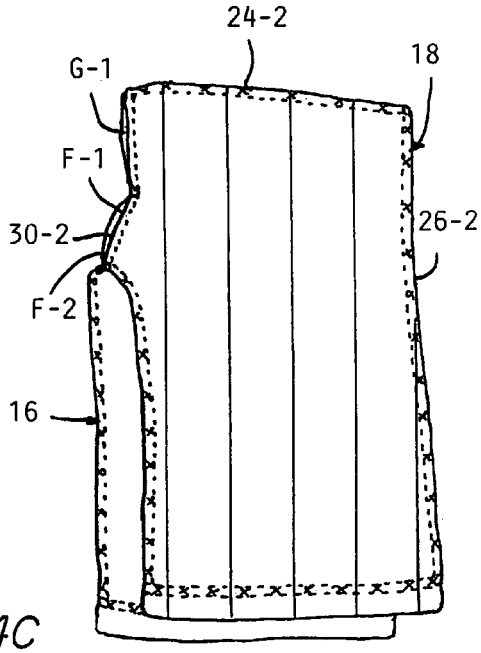
FIG. 4C is a reverse view of the two sleeves shown in FIG. 4B.
Figure 5:
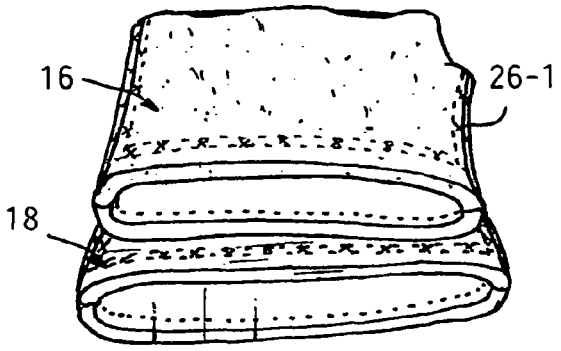
FIG. 5 is a pictorial end view of the two sleeves as shown in FIG. 4 from the cuff end.

After the sleeve 16, 18 are folded atop each other, segments F-1 of panels 20A, 20B of sleeve 16 are each wrapped into contact with a respective adjacent segment F-2 of sleeve 18 and sewn together forming seams 30-1, 30-2 (FIGS. 4B, 4C, 6).

The thumb sides B-1, B-2 are sewn together from the cuff end to the peaks E-1, E-2 forming seams 28-1, 28-2 (FIG. 6).

Figure 7:
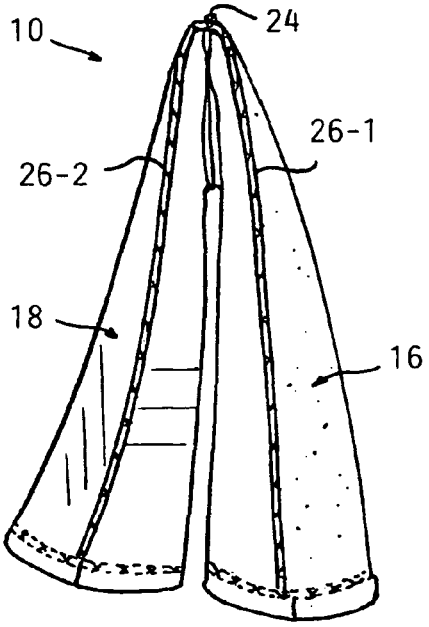
FIG. 7 is a pictorial view of the two sleeves shown in FIG. 5 shown on edge from the opposite side.

The sides A-1 and A-2 are sewn together or otherwise attached together for their full length, forming seams 26-1 and 26-2 (FIG. 7).

The sewn together ends C-1, C-2 thus form a perimeter at a common outer end of the end to end joined two sleeves 16, 18 formed by sewing of the sides A-1, B-1 and A-2, B-2 together.

The cuff ends D-1, D-2 are hemmed as shown.

The mitten 10 is now formed. In use, the sleeves 16, 18 are turned inside out exposing the finished sleeves 16, 18 as seen in FIG. 4A. Next, one sleeve 16 or 18 is drawn into the other so as to be coextensive with each other and the mitten 10 is then ready to wear as shown in FIGS. 1 and 2.

The through finger opening 34 (FIG. 3) can now be seen as is the thumb opening 12 with the sleeves 16, 18 in position for the mitten 10 to be worn with the fingers and thumb exposed.

Figure 9A:
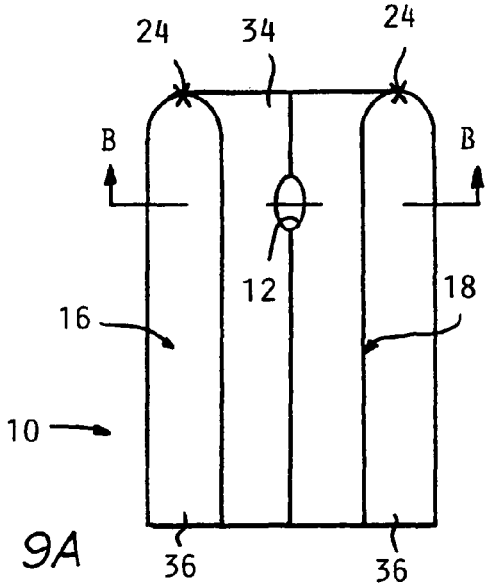
FIG. 9A is a diagrammatic sectional view of the two sleeves included in a mitten according to the invention depicting the end closed and end open pockets defined therein alternatively able to receive a wearer's hand.
Figure 9B:
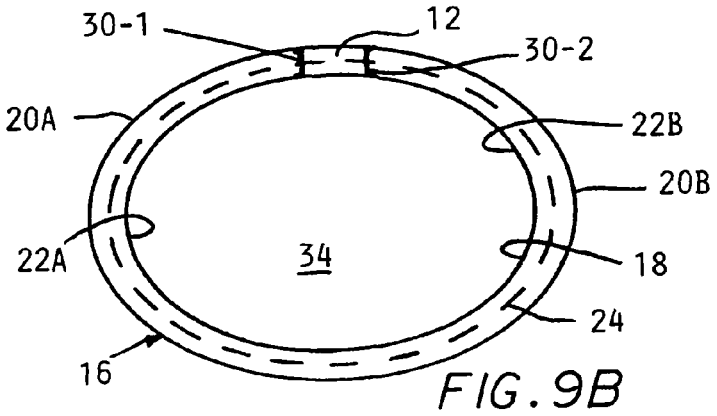
FIG. 9B is a diagrammatic view of the section B-B taken through the mitten in FIG. 9A.

As seen in FIGS. 9A and 9B, when the mitten 10 is in its normal condition with the two sleeves 16, 18 nested together with the finished outside exposed, an opening 34 for the fingers is defined at the outer end, and the thumb opening 12 is defined on one side near the outer end of the mitten 10.

In order to completely enclose the fingers and thumb of a wearer, the wearer's hand is inserted into either side of the space 36 between the sleeves 16, 18. In this case, the outer ends of the space 36 is closed by the seam 24-1, 24-2 and the thumb opening 12 is closed by the seams 32-1, 32-2 so that the fingers and thumb of the wearer are both completely covered.

Figure 8:
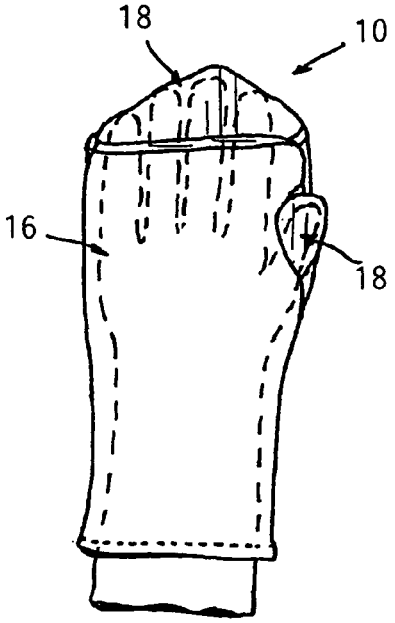
FIG. 8 is a front view of the mitten as shown in FIG. 1 with a hand inserted in an inner pocket between the two sleeves to completely cover the fingers and thumb.

The tips of the covered fingers and thumb may be partially extended by pushing the covered fingers and thumb out the openings 34, 12 respectively, accommodated by stretching of the fabric of the inner sleeve 18 as shown in FIG. 8.

It should be understood that the mitten 10 may be reversed by being turned inside out so that sleeve 16 will be inside and sleeve 18 will be outside.

Figure 11A:
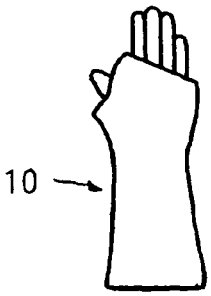
FIGS. 11A-11F are diagrams showing various modes of wearing a mitten according to the invention.
Figure 11B:
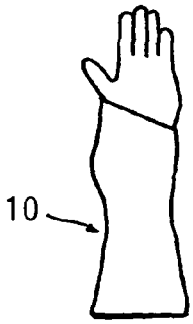

FIGS. 11A-11F show various ways that the mitten 10 can be worn with the fingers and thumb exposed. FIG. 11A shows the normal way with fingers and thumb exposed, while FIG. 11B shows the mitten 10 pulled back onto the forearm and entirely off the hand as an arm warmer.

Figure 11C:
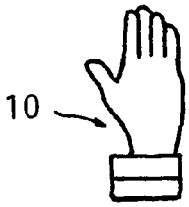

FIG. 11C shows the cuff rolled up to be a wrist warmer.

Figure 11D:
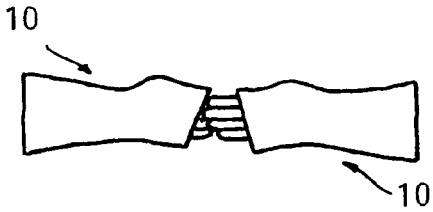

The fingers can be passed into the opposite mitten 10 to function as a muffler as shown in FIG. 11D.

Figure 11E:
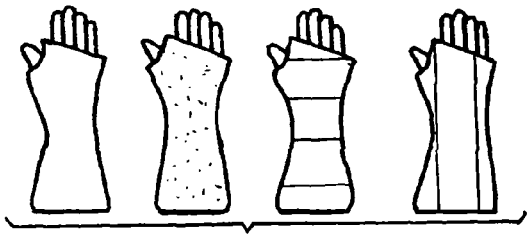
Figure 11F:
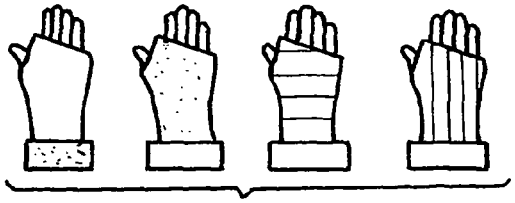

FIG. 11E shows the appearances possible by using various contrasting fabric patterns and/or textures. This contrasting effect can also be achieved by rolling up the cuffs as shown in FIG. 11F to expose a contrasting fabric of the inner sleeve.

The mitten 10 can be worn on either hand by being turned over to have the thumb opening 12 on either side.

It also is possible to use commercially available fabrics which have different thermal wicking or insulating characteristics from one side to the other to be useful in different special activities.

The invention claimed is:

1. A mitten selectively allowing exposure or covering of a wearer's fingers and thumb, comprising:

a pair of flexible sheet material sleeves, each sleeve of a sufficient length so as to be adapted to receive and enclose a wearer's hand including the fingers and thumb thereof, an inner sleeve received within an outer sleeve, at least one of said sleeves being coextensive with another of said sleeves substantially over its entire length, with said inner sleeve nested within said outer sleeve;

outer ends of each of said sleeves connected together and defining a perimeter of a common opening at said outer ends thereof to be adapted to allow full insertion of a wearer's hand into said inner sleeve with the fingers of the wearer passing out through said common opening at the outer ends of said sleeves, and inner ends of said sleeves unconnected to each other to be adapted to receive a hand of a wearer inserted between said separated inner sleeve and said outer sleeve, with the fingers of the wearer thereby covered by said connected together outer ends of said sleeves and the hand of the wearer adapted to be enclosed between said sleeves;

said mitten also having a thumb opening extending through sides of both of said sleeves, a perimeter of said thumb hole having an encircling seam fixing said inner and outer sleeves together around said thumb hole, to be adapted to receive a wearer's thumb inserted through said encircling seam extending around said thumb hole so as to be exposed when a hand is inserted into said inner sleeve but is prevented from passing through said thumb hole when a wearer's hand is inserted between said sleeves by said encircling seam, whereby a wearer's fingers and thumb are thereby exposed by insertion of a wearer's hand fully into said inner sleeve with the wearer's fingers passing out through said common opening at said outer end of said sleeves and the wearer's thumb inserted through said encircling seam around said sleeve holes, but adapted to cover the hand and fingers of a wearer when the hand of a wearer is inserted between said unconnected inner ends of said inner and outer sleeves.

2. The mitten according to claim 1 wherein each of said sleeves are constructed of two pairs of fabric panels each of said panels in each pair attached together along opposite sides thereof to form a respective sleeve.

3. The mitten according to claim 2 wherein said thumb hole of each sleeve is formed intermediate one side of each sleeve by a seam joining a segment of one side of each panel forming the sleeve to a segment of one side of a respective panel of the other pair of said panels forming the other sleeve, said seams together forming said encircling seam about said thumb hole of each sleeve.

4. The mitten according to claim 1 wherein said sleeves are each of a color or texture contrasting with each other so as to be reversible to present a different exterior appearance.

5. The mitten according to claim 2 wherein each of said panels in each pair has a different contrasting appearance from each other and with each of the panels in the other pair.

6. The mitten according to claim 5 wherein each panel has opposite sides of differing appearance.

7. The mitten according to claim 1 wherein said sleeves are each constructed of fabric material, said perimeters of said common opening at said outer ends of said sleeves are fixed to each other end to end by a sewn seam extending about said perimeters.

8. The mitten according to claim 3 wherein said one side of each panel in each pair of said panels is cut in a pattern so as to form an intermediate peak along said one side thereof and said segment sloping back in from said peak, towards an inner end of said respective sleeves to widen said mitten adjacent said thumb holes.

* * * * *